US007681782B2

(12) United States Patent
Bondarik

(10) Patent No.: US 7,681,782 B2
(45) Date of Patent: Mar. 23, 2010

(54) COLLAPSIBLE GIFT BOX

(75) Inventor: Hanna Bondarik, Middlesex, NJ (US)

(73) Assignee: Bath & Body Works Brand Management, Inc., Reynoldsburg, OH (US)

( * ) Notice: Subject to any disclaimer, the term of this patent is extended or adjusted under 35 U.S.C. 154(b) by 592 days.

(21) Appl. No.: 11/636,086

(22) Filed: Dec. 8, 2006

(65) Prior Publication Data

US 2008/0099542 A1 May 1, 2008

Related U.S. Application Data

(63) Continuation-in-part of application No. 11/586,935, filed on Oct. 26, 2006.

(51) Int. Cl.
*B65D 5/36* (2006.01)

(52) U.S. Cl. ..... 229/117.07; 229/122.32; 229/141

(58) Field of Classification Search ..... 229/117.01, 229/117.07, 117.08, 141, 122.32, 190
See application file for complete search history.

(56) References Cited

U.S. PATENT DOCUMENTS

| | | | | |
|---|---|---|---|---|
| 317,795 | A | 5/1885 | Jaeger | |
| 1,234,421 | A * | 7/1917 | Tinsley | 206/45.22 |
| 1,337,507 | A * | 4/1920 | De Lemos | 229/149 |
| 1,442,837 | A * | 1/1923 | Weber | 229/149 |
| 2,089,831 | A | 8/1937 | Henriksen | |
| 2,206,304 | A | 7/1940 | Ringler | |
| 2,255,223 | A | 9/1941 | Lighter | |
| 2,531,507 | A | 11/1950 | Goodyear | |
| 2,889,103 | A * | 6/1959 | Kuchenbecker | 229/145 |
| 3,270,939 | A * | 9/1966 | Ebelhardt | 229/117.19 |
| 3,658,234 | A * | 4/1972 | Deckys | 229/151 |
| 5,121,876 | A * | 6/1992 | Johnson | 229/117.07 |
| 5,297,726 | A | 3/1994 | Detzel | |
| 6,032,853 | A | 3/2000 | Chevalier | |
| 6,484,931 | B1 * | 11/2002 | Hofte | 229/149 |
| 2003/0085265 | A1 * | 5/2003 | Haim | 229/123.1 |
| 2004/0140345 | A1 | 7/2004 | Kao | |
| 2005/0279816 | A1 | 12/2005 | Kao | |

FOREIGN PATENT DOCUMENTS

| | | |
|---|---|---|
| FR | 2415581 | 8/1979 |
| GB | 463482 | 3/1937 |
| GB | 533914 | 2/1941 |
| GB | 897932 | 5/1962 |
| GB | 1020879 | 2/1966 |
| GB | 2398293 | 8/2004 |

* cited by examiner

*Primary Examiner*—Gary E Elkins
*Assistant Examiner*—Christopher Demeree
(74) *Attorney, Agent, or Firm*—Ward & Olivo

(57) ABSTRACT

A collapsible box has a body with a front panel, a bottom panel, a back panel, a top panel, a closing panel, a left folding panel, a right folding panel, and a back folding panel. The back folding panel has a center panel foldably connected to two side panels. Each of the left and right folding panels comprises two foldably connected panels. The bottom panel edges are foldably connected to edges of the front, back, left folding, and right folding panels. The opposite edges of the top panel are foldably connected to the back and closing panels. The edges of the front panel are foldably connected to one set edges of the left folding and right folding panels, and edges of the back folding panel are foldably connected to opposite set edges of the left folding and right folding panels.

20 Claims, 6 Drawing Sheets

COLLAPSIBLE GIFT BOX

CROSS REFERENCE TO RELATED APPLICATIONS

This application is a continuation-in-part of U.S. patent application Ser. No. 11/586,935, filed Oct. 26, 2006, the entire contents of which is hereby incorporated by reference.

FIELD OF THE INVENTION

The present invention relates to a packaging structure. More specifically, the invention relates to a collapsible gift box comprising plurality of independent panels.

BACKGROUND OF THE INVENTION

The use of cardboard boxes as gift boxes is well known. There are several general classes of cardboard boxes manufactured today that are used as gift boxes.

For instance, many cardboard boxes are pre-constructed by box manufacturers and are directly delivered to customers. These boxes are available for use immediately upon receipt by the customer. That is, the customer does not need to modify the cardboard box in any way. However, pre-constructed cardboard boxes require large amounts of space in order to be shipped, and are easily damaged during transit. As a result, the cost associated with shipping pre-constructed cardboard boxes is high. Similarly, pre-constructed boxes require costly storages space when they arrive at a store, further increasing the costs associated with pre-constructed cardboard boxes. Accordingly, pre-constructed cardboard boxes are economically inefficient.

In an attempt to alleviate the aforementioned problems, foldable cardboard boxes were developed. These boxes, designed as single flat sheets, improve the storage and transportation inefficiencies by reducing the overall volume of each cardboard box. In other words, a greater number of single flat sheets occupy the same space as a pre-constructed cardboard box. However, foldable cardboard boxes must be manually constructed by folding and/or tucking various parts of the single sheet together. The time and labor costs associated with manually constructing these cardboard boxes is high. Costly adhesive may be required to ensure that the single sheet foldable box maintains an appropriate shape. Accordingly, single sheet foldable cardboard boxes are economically inefficient. Further, the constant folding of a single foldable cardboard box along the proper line weakens the structural integrity of the resulting cardboard box. As a result, foldable boxes are generally not as sturdy as pre-constructed cardboard boxes.

Foldable cardboard boxes can also be constructed from a plurality of cardboard sheets. This type of collapsible box is comprised of a plurality of separate cardboard sheets for each wall of the box (e.g., top, bottom, and sides). Typically, the cardboard sheets are attached to each other via a decorative layer such as felt. This type of foldable box is much sturdier than a single sheet foldable box because it is comprised of separate cardboard sheets. However, the current box configurations provide rough surfaces and cluttered folding lines.

Thus, it would be advantageous to have a foldable cardboard box which is constructed of a plurality of cardboard sheets, which is relatively inexpensive, and which has aesthetically clean lines of folding. This provides clean interior surface associated with more volume that prevents items placed inside from snagging and ruining the box. The present invention is such an article.

SUMMARY OF THE INVENTION

The present invention provides a collapsible box comprising a body having a front panel, a bottom panel, a back panel, a top panel, a closing panel, a left folding panel, a right folding panel, and a back folding panel. The back folding panel comprises a center panel foldably connected to two side panels. Each of the left and right folding panels comprises two foldably connected panels. The bottom panel edges are foldably connected to edges of the front, back, left folding, and right folding panels. The opposite edges of the top panel are foldably connected to the back and closing panels. The edges of the front panel are foldably connected to one set edges of the left folding and right folding panels, and edges of the back folding panel are foldably connected to opposite set edges of the left folding and right folding panels. Further, the back center panel can be permanently attached to the back panel. The front panel, left folding panel, back panel, right folding panel, bottom panel, and top panel form exterior surface walls of the box, while the front panel, back folding panel, left folding panel, right folding panel, bottom panel, and top panel form interior surface walls of the box. As described in greater detail below, the back, left, and right folding panels allow the box to be folded in a flat position.

To collapse the box, a user may pull the back panel and push the front panel flat with respect to the bottom panel. As a result, the foldably connected panels of the left folding panel and right folding panel fold with respect to each other and the back two side panels fold with respect to the back center panel. Or else, to erect the box, a user may push the back panel and pull the front panel upward with respect to the bottom panel. As such, the foldably connected panels of the left folding panel and right folding panel unfold with respect to each other and the back two side panels unfold with respect to said back center panel.

To close the box while it's in an erect position, the closing panel and the front panel may include attachment means such as, but not limited to removable adhesives, permanent adhesives, glue, magnets, Velcro™, rivets, pins, clasps, or the like. The collapsible box may further comprise additional attachment means to attach the back two side panels to the back panel to maintain the box in an erect position.

The box panels may be constructed of a rigid layer laminated in flexible sheets of material. The folding lines connecting the panels are formed by spacing apart the rigid layers such that the folding lines only consist of flexible sheets. The rigid layer can consist of cardboard, plastic, wood, metal, composite material, or the like. The flexible layers comprise sturdy material that can sustain continuous folding and unfolding. For example, the flexible layer can consist of paper, plastic, felt, decorative paper, composite material, or the like.

The collapsible box may include additional decorative features including, but not limited to: transparent windows, handles, bows, tassels, mirrors, locks, dividers, or the like.

In light of the foregoing, it is an object of the present invention to provide an improved collapsible box.

Another object of the present invention is to provide a collapsible box comprising a plurality of independent panels.

Another object of the present invention is to provide a collapsible box comprising aesthetically clean folding lines.

Yet another object of the present invention is to provide a collapsible box with a plain interior surface.

Another object of the present invention is to provide a collapsible box with a large inner volume.

Another object of the present invention is to provide a collapsible box which is easily assembled.

Still another object of the present invention is to provide a collapsible box which is easily collapsed.

A further object of the present invention is to provide a collapsible box which is easily erected.

Yet a further object of the present invention is to provide a collapsible box with a sturdy configuration.

BRIEF DESCRIPTION OF THE DRAWINGS

A further understanding of the present invention can be obtained by reference to the preferred embodiment and corresponding alternate embodiments as set forth in the illustrations of the accompanying drawings. Although the illustrated embodiments are merely exemplary of systems for carrying out the present invention, both the organization and method of operation of the invention, in general, together with further objectives and advantages thereof, may be more easily understood by reference to the drawings and the following description. The drawings are not intended to limit the scope of this invention, which is set forth with particularity in the claims as appended or as subsequently amended, but merely to clarify and exemplify the specific methods and instrumentalities disclosed.

For a more complete understanding of the present invention, reference is now made to the following drawings in which.

DETAILED DESCRIPTION OF THE PREFERRED EMBODIMENTS

Figure 1:
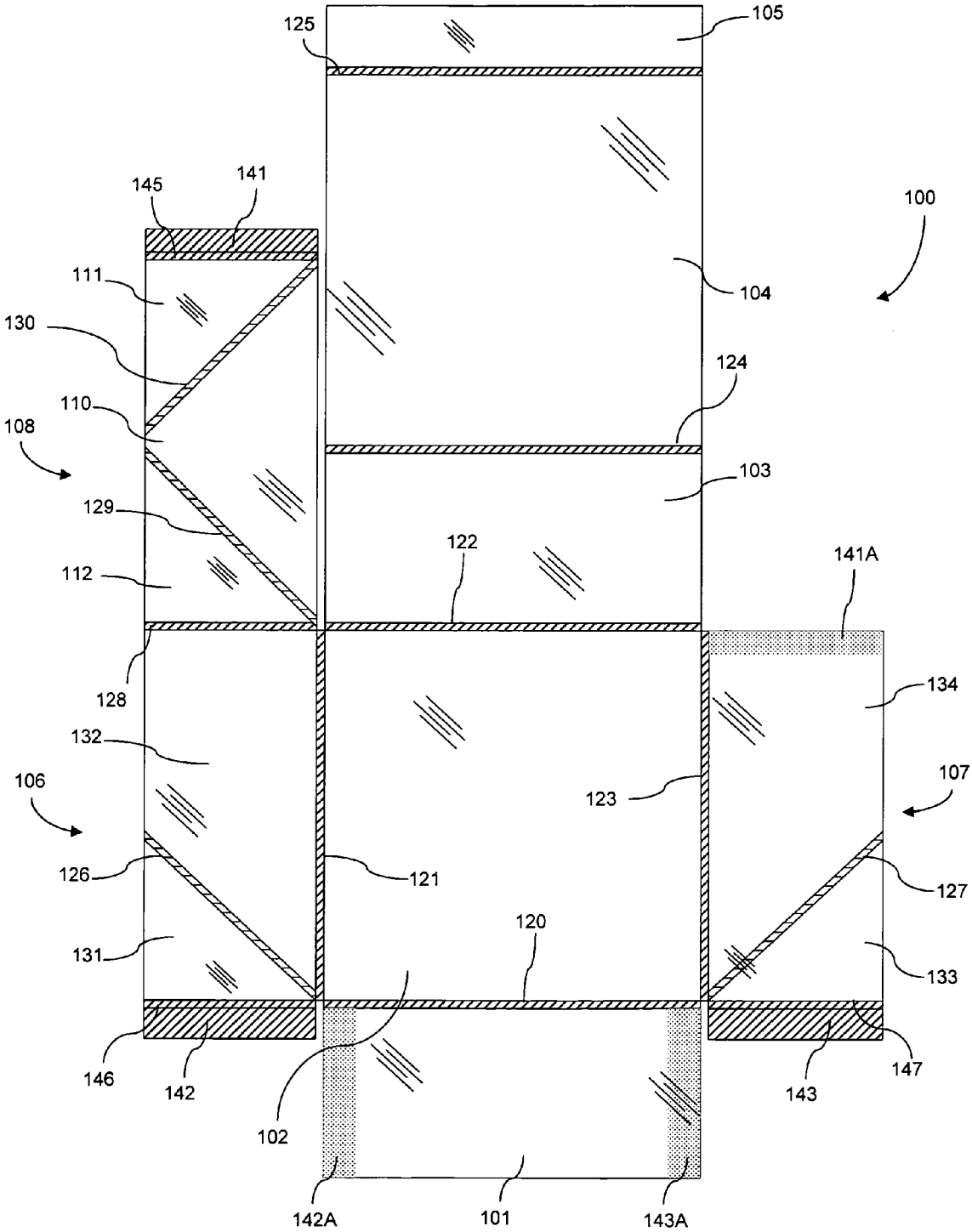
FIG. 1 illustrates a pane top view of a collapsible box body in accordance with the present invention.
Figure 2:
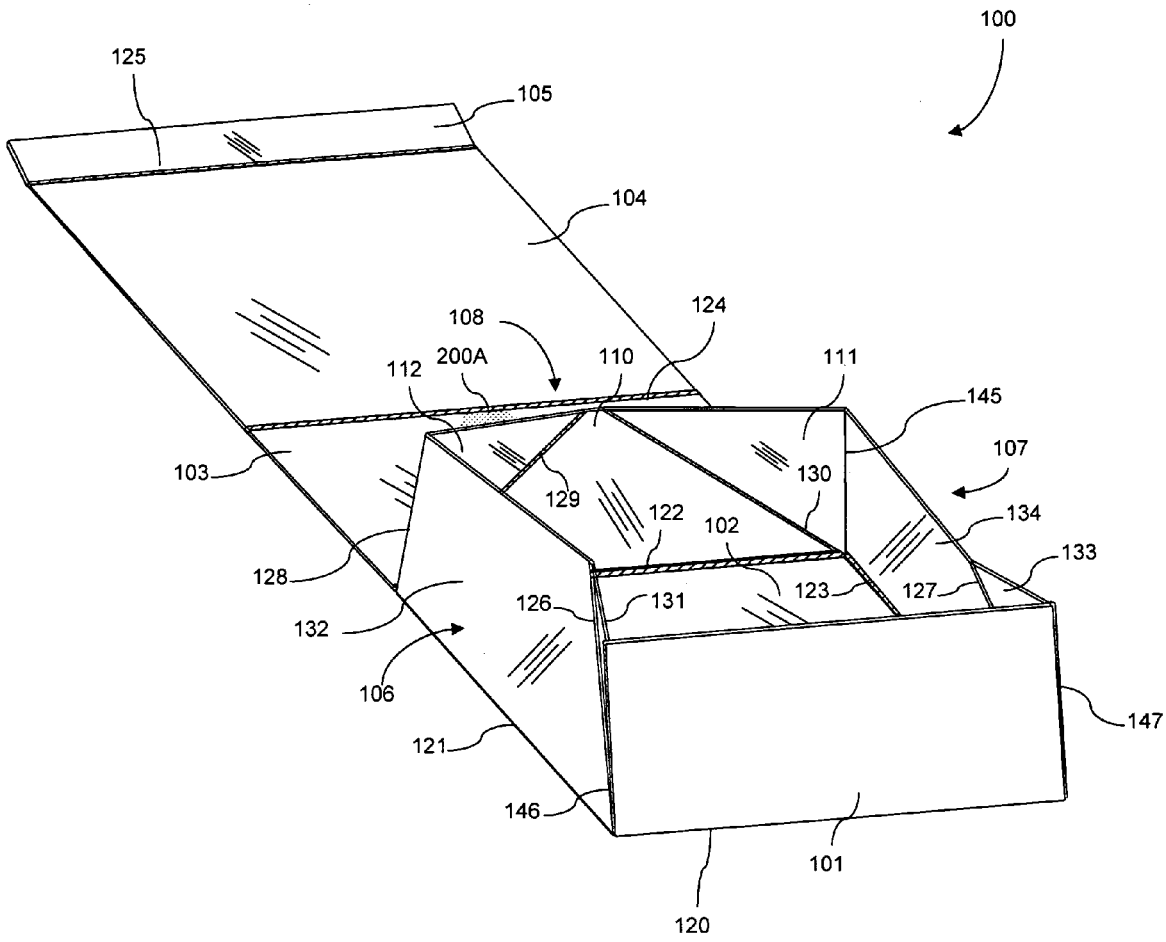
FIG. 2 illustrates a perspective view of an assembled collapsible box in accordance with the present invention.

A detailed illustrative embodiment of the present invention is disclosed herein. However, the present invention may be embodied in a wide variety of forms, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present invention.

Moreover, well known methods and procedures for both carrying out the objectives of the present invention and illustrating the preferred embodiment are incorporated herein by reference but have not been described in detail as not to unnecessarily obscure aspects of the present invention.

Referring to the drawings wherein like numerals indicate like elements throughout, FIGS. 1-6 show a collapsible box 100. The box may comprise various materials known to one skilled in the art. However, durable materials and configurations are preferred which allow continuous folding and unfolding of the box without causing wear to the folding lines. In accordance to the preferred embodiment of the present invention, collapsible box 100 comprises a plurality of panels made from a rigid layer laminated in flexible layers. As such, each panel comprises a rigid inner layer and at least one flexible layer on each opposing surface: The panels are attached along their edges via foldable connections. The foldable connections are formed by spacing apart the rigid layers of the panels such that the connections only comprise flexible layers (i.e., absent the rigid layer). As the flexible layers will experience significant wear from folding and unfolding the box, durable materials are preferred. The flexible layers may comprise durable paper, plastic, felt, decorative paper, composite material, or the like. The rigid layer may comprise cardboard, plastic, wood, metal, composite material, or the like.

During the manufacturing process, the rigid layers of the box panels are laid flat with respect to each other, as depicted in FIG. 1, with desired spacing. The chosen spacing is determined by the desired folding angle of the neighboring panels (e.g., 90°, 180°, etc.). Then, the panels may be laminated with at least one sheet of flexible layer on the upper surface and at lest one sheet of flexible layer on the bottom surface. Alternatively, the box body may be laminated in sections leaving flexible flaps on the panel edges to interconnect the sections. After the box body is laminated, the remaining material is cut to size and the box edges are finished, as is well known in the art.

In accordance with the present invention, collapsible box 100 comprises bottom panel 102, front panel 101, back panel 103, top panel 104, left folding panel 106, right folding panel 107, closing panel 105, and back folding panel 108. Back folding panel 108, left and right folding panels 106 and 107 actively fold and unfold to erect and collapse box 100.

Back folding panel 108 is divided into three sections comprising center panel 110 and two side panels 111-112. Back side panels 111-112 are 45°/45°/90° triangles that span the two upper corners of back folding panel 108. Back center panel 110 is the remainder center section of the folding panel 108 that forms larger 45°/45°/90° triangles, but forms 45°/45°/135°/135° trapezoid as the width of back folding panel 108 increases. Back side panels 111-112 are diagonally connected along folding connections 129-130 to back center panel 110.

Left folding panel 106 and right folding panel 107 are diagonally divided into foldably connected panels 131-134. Panels 131 and 133 form 45°/45°/90° triangles and the remainder panels 132 and 134 form 90°/90°/45°/135° trapezoids. Panels 131 and 132 of left folding panel 106 are foldably connected along folding connection 126. Similarly, the right foldably connected panels 134 and 133 are foldably connected along folding connection 127.

The outer edges of bottom panel 102 are foldably connected to the edges of front panel 101, left folding panel 106, back panel 103, and right folding panel 107 via foldable connections 120, 121, 122, and 123, respectfully. The opposing outer edges of top panel 104 are foldably connected to the edges of back panel 103 and closing panel 105 via foldable connection 124 and 125, respectfully. One side edge of left folding panel 106, orthogonal to the edge connected to bottom panel 102, is connected to one side edge of back folding panel 108 along foldable connection 128. The second side edge of back folding panel 108 is connected to connecting flap 141 along folding line 145. Additionally, the second side edges of left folding panel 106 and right folding panel 107 are connected to connection flaps 142 and 143 along folding lines 146 and 147. Preferably, connecting flaps 141, 142, and 143 are made of at lest two flexible layers.

To assemble collapsible box 100, left folding and right folding panels 106 and 107 are folded orthogonally with respect to bottom panel 102 along lines 121 and 123. Connecting flaps 142 and 143 are permanently adhered to areas 142A and 143A of front panel 101 to connect the side edges of front panel 101 to fist side edges of left folding and right folding panels 106-107. Back folding panel 108 is folded orthogonally with respect to left folding panel 106 along line 128 and placed parallel to back panel 103. Connecting flap 141 is permanently adhered to area 141A of right folding panel 107 to connect the second side edge of back folding panel 108 to the second side edge of right folding panel 107. This positions collapsible box 100 to an assembled position illustrated in FIG. 2. Connecting flaps 141-143 can adhere to the surface of areas 141A-143A or alternatively, connecting flaps 141-143 can be inserted between the flexible layer and rigid layer of the panels to provide a better finished product. It is also understood by one skilled in the art that any other method of assembling the panels of box 100 to an assembled position of FIG. 2 can be utilized without departing from the scope of the present invention.

Figure 3:
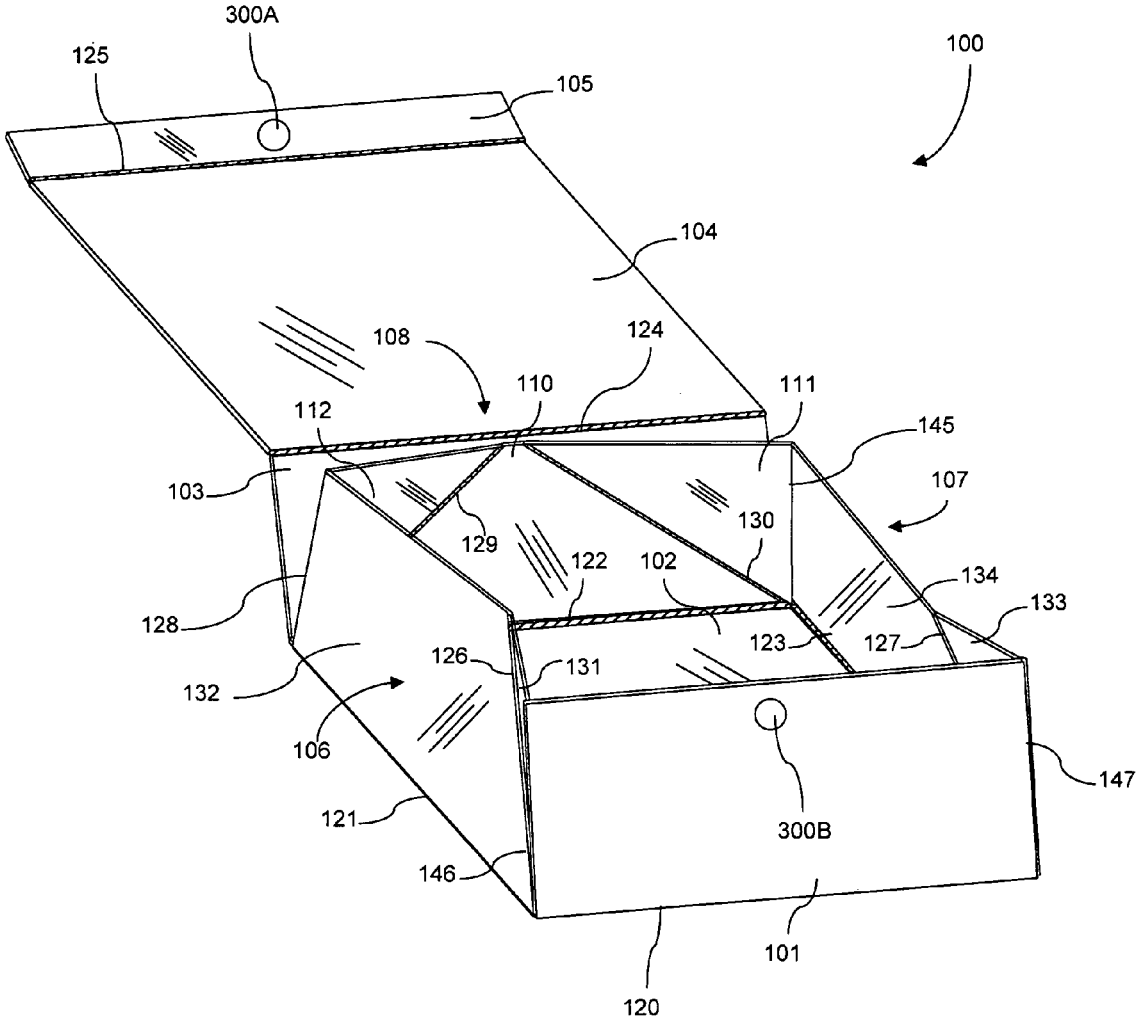
FIG. 3 illustrates a perspective view of a collapsible box in an erect position in accordance with the present invention.

To enhance the ease of erecting and collapsing box 100, back panel 103 is folded orthogonally in relation to bottom panel 102 along folding line 122. Then, back center panel 110 is permanently adhered to area 200A of back panel 103, as illustrated in FIG. 3. The fully erect collapsible box in FIG. 3 comprises interior surface walls defined by bottom panel 102, left folding panel 106, right folding panel 107, front panel 101, back folding panel 108, and top panel 104. The interior surface is further defined by corners along folding connections 145, 146, 147, and 128. Advantageously, the aesthetic interior surface of the present box configuration consists of smooth plain wall surfaces without protruding edges. As a result, objects cannot get "snagged" and ruin the box.

Figure 4:
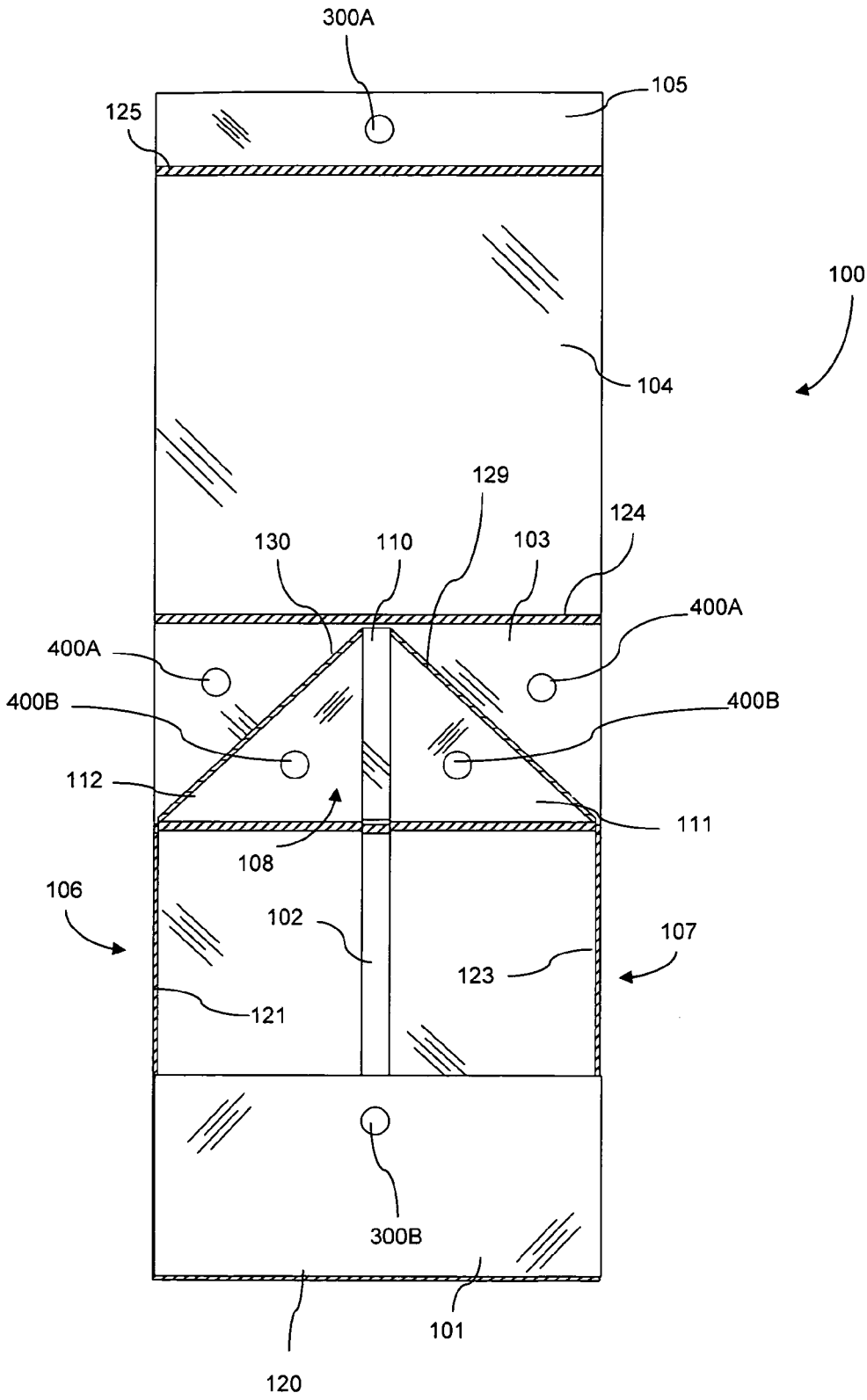
FIG. 4 illustrates a pane top view of a collapsible box when in a collapsed position in accordance with the present invention.
Figure 5:
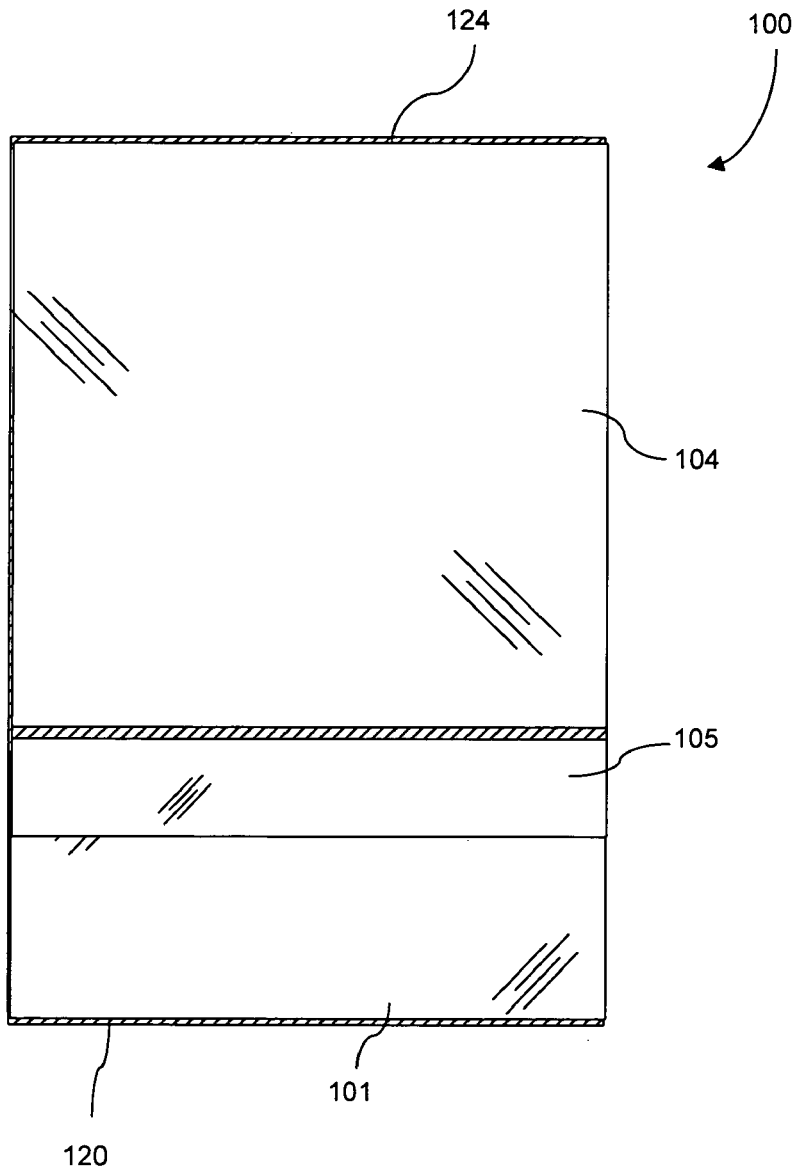
FIG. 5 illustrates a pane top view of a collapsible box in a smaller collapsed position in accordance with the present invention.

The box is collapsed by unfolding back panel 103 along line 122 and folding front panel 101 along line 120 with respect to bottom panel 102, thereby pulling back center panel 110 flat to collapsed position of FIG. 4. This causes back two side panels 111-112 to fold with respect to back center panel 110 along lines 130 and 129. Additionally, panel 131 folds with respect to panel 132 of left folding panel 106' along line 126 and panel 133 folds with respect to panel 134 of right folding panel 107 along line 127. To further collapse the box into a smaller configuration, top panel 104 can be folded with respect to the back panel 103 along line 124 as illustrated in FIG. 5. As such, the box provides a small collapsed configuration which is easy to ship and store.

Figure 6:
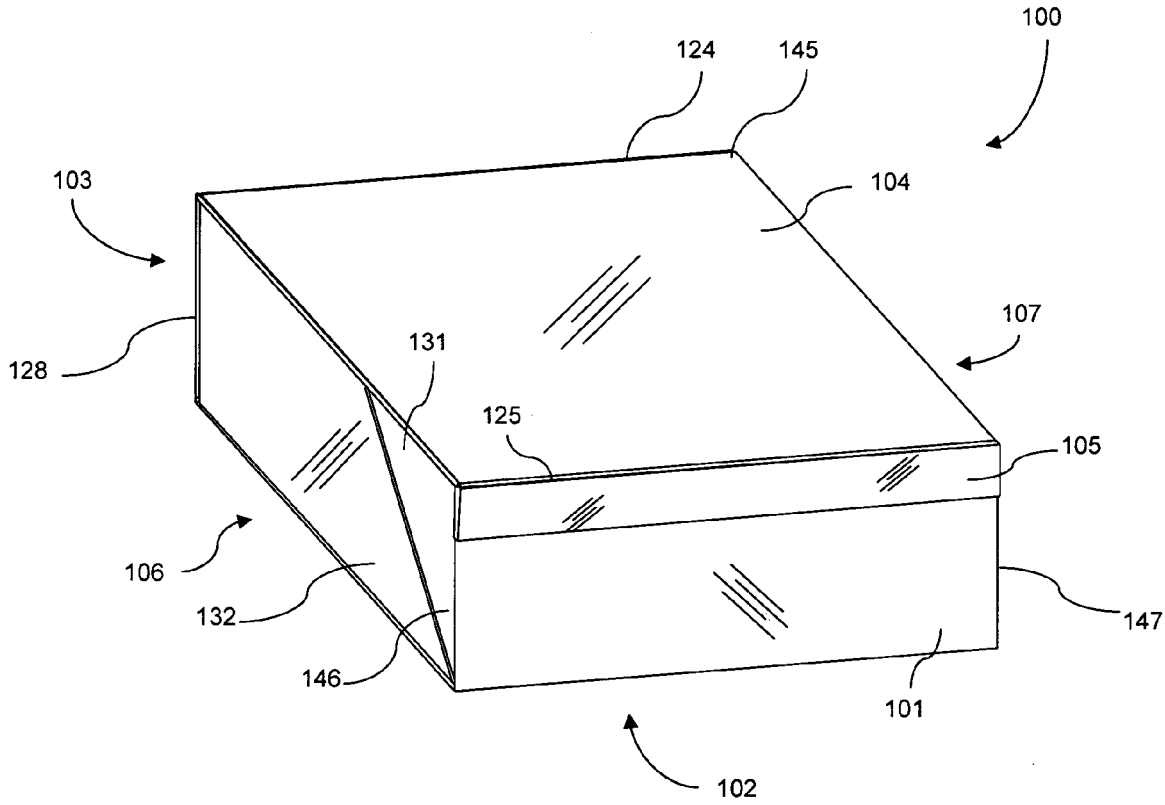
FIG. 6 illustrates a perspective view of a collapsible box in an erect and closed position in accordance with the present invention.

To erect the box from the collapsed position of FIG. 5, top panel 104 is unfolded with respect to back panel 103 along line 124 to a position of FIG. 4. Front panel 101 is unfolded and back panel 103 is folded orthogonally with respect to bottom panel 102, thereby unfolding back two side panels 111-112 with respect to back center panel 110 along lines 130 and 129. Additionally, panels 131 and 133 are unfolded with respect to panels 132 and 134 of left folding panel 106 and right folding panel 107, respectfully, to an erect position of FIG. 3. The box is closed by folding top panel 104 with respect to back panel 103 along line 124 and folding closing panel 105 along line 125 to be placed on front panel 101 as illustrated in FIG. 6. The closed collapsible box 100 comprises exterior surface walls defined by front panel 101, left folding panel 106, back panel 103, right folding panel 107, bottom panel 102, and top panel 104. The exterior surface is further defined by corners along folding connections 128, 145, 146, and 147.

The collapsible box of the present invention can further comprise attachment means to attach various panels to one another. The utilized attachment means can include removable adhesives, permanent adhesives, glue, magnets, Velcro™, rivets, pins, clasps, or the like. For example, as illustrated in FIG. 3, magnets 300A and 300B can be included to attach closing panel 105 to front panel 101, so that box 100 can be maintained in a closed position of FIG. 6.

Further, as illustrated in FIG. 4, Velcro™ hooks 400A and loops 400B, or vice versa, can be incorporated into back panel 103 and back two side panels 111-112. In an erect position (FIG. 3), hooks 400A connect to loops 400B to attach back two side panels 111-112 to back panel 103 to maintain the box in an erect position. Temporary attachment means allow the box to be folded and unfolded as needed. However, permanent attachment means can also be utilized if it is desired for the box to stay in one configuration. For example, instead of Velcro™ or magnets, adhesive can be used covered with a removable film. When the box is ready to be placed in a desired position, the film is removed to expose the adhesive to adhere the desired panels in place. Although circular attachment means are illustrated, it is obvious to one skilled in the art that any other attachment shapes can be utilized without departing from the scope of the present invention including, but not limited to strips, triangles, squares, rectangles, or the like.

Additionally, the attachment means can span the entire surface of the panel. For instance, the entire surface of closing flap 105 can be covered with adhesive (not shown) with a removable film that is removed to adhere closing flap 105 to front panel 101.

Other decorative features (not shown) can be incorporated into the box design. As an example, a transparent window can be placed in the center of closing panel 104 which allows a user to see the internal contents of box 100. Optional handles can be incorporated on the exterior surface of left and right folding panels 106 and 107, or any other panels, that allow a user to lift box 100. Other features can include, but are not limited to, bows, tassels, mirrors, locks, dividers, or the like.

From the foregoing description of the preferred embodiment, which has been set forth in considerable detail for the purpose of making a complete disclosure of the present invention, it can be seen that the present invention comprises a collapsible box. Specifically, the collapsible box comprises a body having a front panel, a bottom panel, a back panel, a top panel, a closing panel, a left folding panel, a right folding panel, and a back folding panel. The back folding panel comprises a center panel foldably connected to two side panels and each of the left and right folding panels comprises two foldably connected panels. The bottom panel edges are foldably connected to edges of front, back, left folding, and right folding panels. The opposite edges of the top panel are foldably connected to the back and closing panels. The edges of the front panel are foldably connected to one set edges of the left folding and right folding panels, and edges of the back folding panel are foldably connected to opposite set edges of the left folding and right folding panels.

It will be appreciated by those skilled in the art that changes can be made to the embodiment described above without departing from the broad inventive concept thereof. It is understood, therefore, that this invention is not limited to the particular embodiment disclosed, but it is intended to cover all modifications that are within the scope and spirit of the invention as defined by the appended claims.

What is claimed is:

1. A collapsible box comprising:

a body having a front panel, a bottom panel, a back panel, a top panel, a closing panel, a left folding panel, and a right folding panel;

a back folding panel connected to said left folding panel along a first common edge, and also connected to said right folding panel along a second common edge, wherein said back folding panel comprises a center panel and a first and second side panel, wherein said center panel includes a third common edge with said first side panel and includes a fourth common edge with said second side panel, wherein said back folding panel collapses along said third and fourth common edges, wherein said left folding panel is connected to said bottom panel along a fifth common edge, and is connected to said front panel along a sixth common edge, wherein said left folding panel comprises a third and fourth side panel, wherein said third side panel includes a seventh common edge with said fourth side panel for collapsing said left folding panel, wherein said right folding panel is connected to said bottom panel along an eighth common edge, and is connected to said front panel along a ninth common edge, wherein said right folding panel comprises a fifth and sixth side panel, wherein said fifth side panel includes a tenth common edge with said sixth side panel for collapsing said right folding panel, wherein each of said left folding panel, right folding panel, back folding panel, front panel, bottom panel, and top panel enclose an interior space of said body, wherein edges of said bottom panel are connected to edges of said front panel, and said back panel, wherein a bottom edge of said top panel is connected to said back panel and a top edge of said top panel is connected to said closing panel; and wherein said center panel is permanently connected to an interior surface of said back panel for causing said back panel to be collapsed along said third and fourth common edges, wherein collapsing said back panel away from front panel and collapsing said front panel towards said back panel causes said collapsible box to be collapsed in one motion.

2. A collapsible box according to claim 1 wherein said front panel, left folding panel, back panel, right folding panel, bottom panel, and top panel form exterior surface walls of said box.

3. A collapsible box according to claim 1 wherein said front panel, back folding panel, left folding panel, right folding panel, bottom panel, and top panel form interior surface walls of said box.

4. A collapsible box according to claim 1 wherein said back two side panels fold with respect to said back center panel and said two foldably connected panels of said left folding panel and right folding panel fold with respect to each other to collapse said box.

5. A collapsible box according to claim 1 wherein said back two side panels unfold with respect to said back center panel and said two foldably connected panels of said left folding panel and right folding panel unfold with respect to each other to erect said box.

6. A collapsible box according to claim 1 wherein said back center panel is permanently attached to said back panel.

7. A collapsible box according to claim 1 further comprises attachment means to attach said closing panel to said front panel to close said box.

8. A collapsible box according to claim 7 wherein said attachment means is at least one selected from a group consisting of removable adhesives, permanent adhesives, glue, magnets, hook and loop connection, rivets, pins, and clasps.

9. A collapsible box according to claim 1 further comprises attachment means to attach said back two side panels to said back panel to maintain said box in an erect position.

10. A collapsible box according to claim 9 wherein said attachment means is at least one selected from a group consisting of removable adhesives, permanent adhesives, glue, magnets, hook and loop connection, rivets, pins, and clasps.

11. A collapsible box according to claim 9 wherein said rigid layer is at least one selected from a group consisting of cardboard, plastic, wood, metal, and composite material.

12. A collapsible box according to claim 11 wherein said rigid layer is laminated with at least one flexible layer.

13. A collapsible box according to claim 12 wherein said at least one flexible layer is at least one selected from a group consisting of paper, plastic, felt, decorative paper, and composite material.

14. A collapsible box according to claim 1 wherein said body panels comprise a rigid layer.

15. A collapsible box according to claim 1 wherein said foldable connections comprise at least one flexible layer capable of folding.

16. A collapsible box according to claim 15 wherein said at least one flexible layer is at least one selected from a group consisting of paper, plastic, felt, decorative paper, and composite material.

17. A collapsible box according to claim 1 wherein said top panel comprises a transparent window.

18. A collapsible box according to claim 1 wherein said left folding panel and right folding panel comprise handles.

19. A collapsible box comprising:

a body having a front panel, a bottom panel, a back panel, a top panel, a closing panel, a left folding panel, a right folding panel, and a back folding panel, wherein said back folding panel is connected to said left folding panel along a first common edge, and is connected to said right folding panel along a second common edge, wherein said back folding panel comprises a center panel and a first and second side panel, wherein said center panel includes a third common edge with said first side panel and includes a fourth common edge with said second side panel, wherein said back folding panel collapses along said third and fourth common edges, wherein said left folding panel is connected to said bottom panel along a fifth common edge, and is connected to said front panel along a sixth common edge, wherein said left folding panel comprises a third and fourth side panel, wherein said third side panel includes a seventh common edge with said fourth side panel for collapsing said left folding panel, wherein said right folding panel is connected to said bottom panel along an eighth common edge, and is connected to said front panel along a ninth common edge, wherein said right folding panel comprises a fifth and sixth side panel, wherein said fifth side panel includes a tenth common edge with said sixth side panel for collapsing said right folding panel, wherein each of said left folding panel, right folding panel, back folding panel, front panel, bottom panel, and top panel enclose an interior space of said body, wherein edges of said bottom panel are connected to edges of said front panel, and said back panel, wherein a bottom edge of said top panel is connected to said back panel and a top edge of said top panel is connected to said closing panel;

wherein said center panel is permanently connected to an interior surface of said back panel for causing said back panel to be collapsed along said third and fourth common edges, wherein collapsing said back panel away from front panel and collapsing said front panel towards said back panel causes said collapsible box to be collapsed in one motion.

20. A collapsible box comprising:

a body having a front panel, a bottom panel, a back panel, a top panel, a closing panel, a left folding panel, and a right folding panel;

a back folding panel connected to said left folding panel along a first common edge, and also connected to said right folding panel along a second common edge, wherein said back folding panel comprises a center panel and a first and second side panel, wherein said center panel includes third common edge with said first side panel and includes a fourth common edge with said second side panel, wherein said back folding panel collapses along said third and fourth common edges;

a first attachment means to attach said closing panel to said front panel; and a second attachment means to attach said center panel to said back panel;

wherein edges of said bottom panel are connected to edges of said front, back, left folding, and right folding panels;

wherein opposite edges of said top panel are connected to said back and closing panels;

wherein said front panel is connected to said left folding panel along a fifth common edge, and also connected to said right folding panel along a sixth common edge; and wherein said center panel is permanently attached to said back panel, wherein collapsing said back panel away from said front panel, and collapsing said front panel towards said back panel causes said collapsible box to be collapsed in one motion.

* * * * *